US007556248B2

(12) United States Patent
Müller et al.

(10) Patent No.: US 7,556,248 B2
(45) Date of Patent: Jul. 7, 2009

(54) METHOD AND APPARATUS FOR PRODUCING FINAL PRINTED PRODUCTS

(75) Inventors: Erwin Müller, Dürnten (CH); Markus Felix, Richterswil (CH)

(73) Assignee: Ferag AG, Hinwil (CH)

( * ) Notice: Subject to any disclaimer, the term of this patent is extended or adjusted under 35 U.S.C. 154(b) by 170 days.

(21) Appl. No.: 11/227,059

(22) Filed: Sep. 15, 2005

(65) Prior Publication Data

US 2006/0055102 A1 Mar. 16, 2006

(30) Foreign Application Priority Data

Sep. 15, 2004 (CH) ..... 1515/04

(51) Int. Cl.
*B65H 39/00* (2006.01)

(52) U.S. Cl. ..... 270/52.19; 270/52.14; 270/52.16; 270/52.23

(58) Field of Classification Search ..... 270/52.14, 270/52.16, 52.19, 52.22, 52.23, 52.25
See application file for complete search history.

(56) References Cited

U.S. PATENT DOCUMENTS 4,046,367 A 9/1977 Merker et al.
4,743,005 A * 5/1988 Reist ..... 270/52.22
4,840,365 A * 6/1989 Kobler et al. ..... 270/52.19
4,867,429 A 9/1989 Infanger
5,443,250 A * 8/1995 Gosslinghoff ..... 270/52.23
5,562,278 A * 10/1996 Muller et al. ..... 270/58.21
6,234,466 B1 5/2001 Infanger
6,311,968 B1 11/2001 Linder et al.

FOREIGN PATENT DOCUMENTS

| | | | |
|---|---|---|---|
| CH | 649 267 | A5 | 5/1985 |
| DE | 1 817 030 | | 8/1969 |
| EP | 0 237 701 | A1 | 9/1987 |
| EP | 0 301 244 | A1 | 2/1989 |
| EP | 0 346 578 | | 12/1989 |
| EP | 0 554 801 | A1 | 8/1993 |
| EP | 0 911 289 | A1 | 4/1999 |
| WO | WO 98/33656 | | 8/1998 |

* cited by examiner

*Primary Examiner*—Gene Crawford
*Assistant Examiner*—Leslie A Nicholson, III
(74) *Attorney, Agent, or Firm*—Alston & Bird LLP

(57) ABSTRACT

In order to produce final printed products (14) in the same compartment (12), a first product for insertion (22) is inserted into a first folded printed product (10), and a second product for insertion (28) is inserted into a second folded printed product (24). The printed products (10, 24) are displaced in the direction of the folds (16), and as a result each of the printed products (10, 24) has an edge section (26) projecting beyond the other printed product. This permits fault-free, simple access to each of the printed products (10, 24) in order to open and insert the products for insertion (22, 28).

14 Claims, 7 Drawing Sheets

METHOD AND APPARATUS FOR PRODUCING FINAL PRINTED PRODUCTS

BACKGROUND OF THE INVENTION

The present invention relates to a method and an apparatus for producing final printed products.

A method and apparatus of this type are disclosed in WO-A-98/33656 and corresponding U.S. Pat. No. 6,234,466, wherein at least one folded preproduct is inserted into a folded main product in the closed state or is closed following insertion. Then, at least one further printed product coming to lie beside the closed preproduct is inserted, whereupon opening of the preproduct and, finally, insertion of at least one further printed product into the product are carried out. According to this method, a final printed product can be produced with two folded preproducts, into which in each case at least one product for insertion is inserted, arranged beside each other in a folded main product. In order to carry out this method, an apparatus has pocket-like compartments each having two side walls, one side wall being assigned a prefold holding element for opening the main product and the preproducts, and the other side wall being assigned a product holding element. In order to open the products, either the compartments can be pivoted or the prefold holding element is arranged such that it can be pivoted from one side wall to the other side wall and back again.

A device for gathering, collating and inserting printed products is disclosed in EP-A-O 346 578. Holding arrangements arranged one behind another have saddle-like supports. The walls of these supports delimit pocket-like holding parts. The printed products inserted into the holding parts by a first feeder are opened by an opening apparatus, so that printed products fed in by means of the feeders can be inserted into the first opened printed product. If the opening apparatus is switched off, the printed products fed into a holding part by the feeders come to lie beside one another. Furthermore, the printed products can be fed in by the feeders with an open side in front, the printed products being opened by means of an opening device and placed astride the saddle-like supports. One of the walls is in each case provided with a gripper and can be pivoted toward the other wall of an adjacent support, in order to open the printed product introduced into the relevant holding part.

In a method disclosed by EP-A-O 911 289, a pocket of an insertion machine is fed with a main product, which is opened in the pocket and then, in order to produce a final printed product, is fed with partial products and/or enclosures by means of insertion. In a subsequent section, a production path of the insertion machine, the pockets in which the final printed products remain are loaded with a further main product, which is opened for the purpose of inserting partial products and/or enclosures.

It is an object of the present invention to further develop a generic method and a generic apparatus of the above described type such that the ability to manipulate the printed products simply and reliably is ensured.

SUMMARY OF THE INVENTION

According to the invention, at least during the insertion of the second product for insertion, the first and the second printed product are arranged in pocket-like compartments so as to be displaced relative to each another in the direction of the folds. As a result, each of the two printed products has an edge section projecting laterally beyond the other printed product, in which means for manipulating the printed products, for example grippers for opening the printed products, can act without there being any risk that the other printed product is undesirably affected.

If the second printed product is inserted already open into the compartment beside the first printed product, then of course opening of this second printed product in the compartment is no longer necessary but, even in this case, the two printed products are displaced relative to each other, at least as the second product for insertion is inserted into the second printed product. This displacement offers possibilities for the action of following manipulations, for example of the closure of the second printed product or the opening of the first printed product.

Furthermore, high productivity is achieved, since two final printed products can be produced in each compartment.

The pocket-like compartments have no conveying means to convey the printed products jointly into an adjacent compartment in the longitudinal direction of the compartments.

In the present connection, a printed product having a fold is also understood to mean a multi-sheet printed product which—instead of a fold—is bound at one edge.

If the first and the second printed product are inserted simultaneously into a compartment so as to be displaced relative to each other, a single feeder or a single feed device, such as a press feeder, is sufficient to feed the printed products in. In addition, displacement of the two printed products in the compartment is unnecessary in this case.

If the first and the second printed product are fed simultaneously and congruently into a compartment, again a single feeder for feeding the printed products in is sufficient. In this case, however, the two printed products arranged in a compartment have to be displaced relative to each other. This displacement can be carried out in a known manner, for example by displacement means as disclosed in EP-A-O 301 244 and in the corresponding U.S. Pat. No. 4,867,429.

Since the first and the second printed product are arranged to be displaced relative to each other in the direction of the folds, the two printed products can also be kept open simultaneously in an extremely simple way, which permits simultaneous insertion of a product for insertion into the two printed products in each case. The simultaneous insertion of products for insertion into the two printed products leads to very high productivity and permits apparatuses to be constructed in a correspondingly space-saving manner.

However, the method according to the invention permits the first product for insertion to be inserted into the first printed product and then the second product for insertion to be inserted into the second printed product. In this case, the first printed product is preferably closed following insertion of the first product for insertion and, with this closure or thereafter, the second printed product is opened for the insertion of the second product for insertion.

The loading of a compartment with a first printed product first and the subsequent loading of this compartment with a second printed product can be carried out by means of two feeders or two feed devices or by means of a single feeder. In the first-named case, the two feeders or feed devices are preferably arranged such that they can be displaced laterally relative to each other, in order to insert the relevant printed products into the compartments so as to be displaced laterally. In the second-named case, the feeder preferably runs with respect to a delivery path of the compartments in such a way that loading of the compartments with the printed products so as to be displaced laterally relative to each other is carried out, it being possible for the printed products to be arranged identically in the active range of the feeder, that is to say do not need to be arranged so as to be displaced laterally relative to each other.

In a preferred way, a start is made with the opening of the second printed product in the lateral edge section, with which it projects beyond the other printed product. The opening means can act in an unambiguous way in the second printed product without there being any risk of a conflict with the first printed product. The opening can be carried out in a manner known generally, for example by means of opening grippers, suction heads, air jets or the like.

A particularly suitable apparatus for producing final printed products in accordance with the method of the invention is described below, and wherein two grippers are arranged in the lateral end regions of the compartments. The grippers are able to reliably grip in each case one of the two printed products which are arranged displaced laterally relative to each other in the compartment. Any risk that the wrong printed product will be gripped is ruled out.

The grippers can be arranged in a fixed manner with respect to the side walls of the compartments; in this case, the compartments are pivoted in order to open the printed products, be it by a movement track with rising and falling inclines, or by pivoting the compartments about a carrier axis. On the other hand, the grippers can be arranged in a preferred manner such that they can be moved back and forth independently of one another between the two side walls of the compartments. In this case, no pivoting of the compartments is necessary in order to open the printed products.

In a preferred way, the grippers can be pivoted about a pivot axis arranged at the base or underneath the base. This permits an extremely simple construction of the pivoting control system, for example by means of slotted guides.

If the apparatus is constructed in such a way that at least one of the two grippers can be stopped between the two side walls, the simultaneous insertion of a product for insertion into the two printed products in each case is made possible. If appropriate, this gripper can be constructed with a holding element, in order to hold a part of the other printed product as well.

BRIEF DESCRIPTION OF THE DRAWINGS

The invention will be explained in more detail by reference to the exemplary embodiments illustrated in the drawings, in which, purely schematically.

DETAILED DESCRIPTION OF THE PREFERRED EMBODIMENTS

Figure 1:
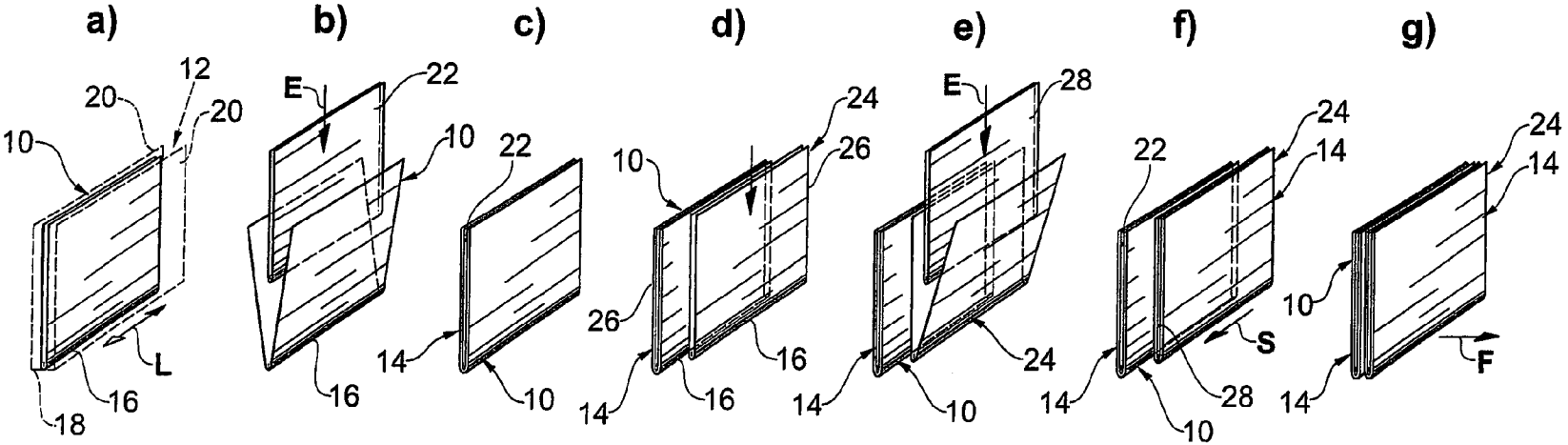
FIG. 1 shows, in a perspective illustration and at different times designated a to g, steps of a first method according to the invention, according to which a first product for insertion is inserted into a first printed product and then a second printed product is fed in and a second product for insertion is inserted into the latter.

FIG. 1*a* shows a pocket-like compartment 12, indicated dashed and populated with a first printed product 10, of an apparatus for producing final printed products 14. The apparatus has a number of compartments 12 arranged one after another in a conveying direction F, whose longitudinal direction L runs transversely, in particular at right angles to the conveying direction F. The first printed product 10 is a folded printed product, for example a main product of a newspaper to be produced. The first printed product 10 has been inserted into the compartment 12 with its fold 16 in front, so that it rests with its fold 16 on a base 18 of the compartment 12 and with a flat side against one of two side walls 20 of the compartment 12 adjoining the base 18.

As FIG. 1*b* shows, the first printed product 10 is opened in the compartment 12 and a first product for insertion 22 is inserted into the opened first printed product 10 in the insertion direction E. The first product for insertion 22 can be, for example, a likewise folded preproduct for the newspaper, an enclosure or the like. The first product for insertion 22 is also to be understood to mean that a plurality of products for insertion can be inserted into the first printed product 10 simultaneously or one after another.

Following the insertion of the first product for insertion 22 into the first printed product 10, the latter is closed—as FIG.

1*c* shows—and is leant against one of the side walls 20, in the present case on the side wall 20 that trails as viewed in the conveying direction F.

Then, as FIG. 1*d* shows, a likewise folded second printed product 24 is introduced into the compartment 12, beside the first printed product 10, in such a way that it comes to rest with its fold 16 on the base 18 but is displaced laterally in the direction of the folds 16 and thus the longitudinal direction L of the compartment 12 with respect to the first printed product 10, in such a way that it projects with an edge section 26 beyond the first printed product 10. In a corresponding way, the first printed product 10 also projects with an edge section 26 beyond the second printed product 24.

Following the opening of the second printed product 24 see FIG. 1*e*—a second product for insertion 28 is inserted into the opened second printed product 24 in the insertion direction E. This can be a product corresponding to the first product for insertion 22 or else a plurality of products.

The two final printed products 14 produced by inserting the first product for insertion 22 and second product for insertion 28 into the first printed product 10 and the second printed product 24, respectively, can then be removed from the relevant compartment 12 in their position displaced relative to each another and can be conveyed away or, as indicated in FIG. 1*f*, can be displaced relative to one another in the compartment 12, as shown by the arrow S, in such a way that they rest congruently against one another, as FIG. 1*g* shows. The two final printed products 14 can then be removed from the compartment 12 for further processing, for example by means of an output conveyor constructed as a clamp transporter.

Figure 2:
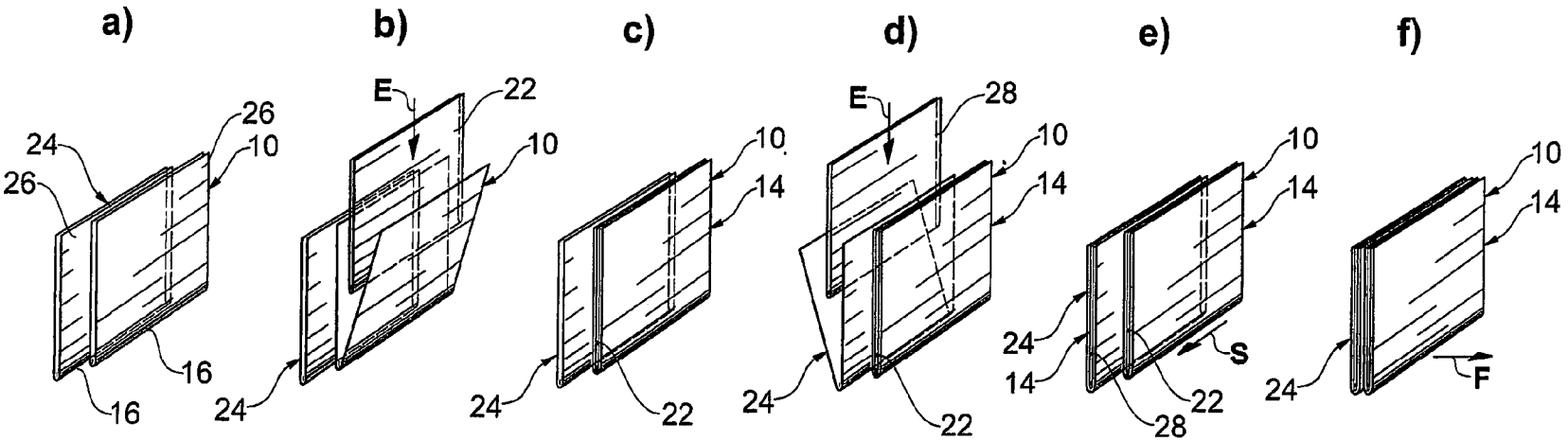
FIG. 2 shows, in the same illustration as FIG. 1, steps of a second embodiment of the method according to the invention, in which two printed products are arranged so as to be displaced relative to each other and in each case a product for insertion is inserted into the two printed products one after the other.

In an embodiment of the method for producing final printed products 14 illustrated in FIG. 2—as FIG. 2*a* shows—the first printed product 10 and the second printed product 24 are introduced with each other into a compartment 12, not shown for reasons of improved clarity. The two printed products 10, 24 lie flat against each other and are displaced in the direction of the folds 16 in such a way that the two printed products 10, 24 each project with a lateral edge section 26 beyond the other printed product 10, 24.

Then, according to FIG. 2*b*, the first printed product 10, in the present case the leading one of the two printed products 10, 24 as viewed in the conveying direction F, is opened and a first product for insertion 22 is inserted into this opened first printed product 10 in the insertion direction E.

The first printed product 10 completed by inserting the first product for insertion 22 to form a final printed product 14 is closed—as FIG. 2*c* shows—and the second printed product 24 is then opened, see FIG. 2*d* in this regard. A second product for insertion 28 is then inserted into the opened second printed product 24, as indicated by the arrow E.

The printed products 10, 24 completed by the insertion to form final printed products 14 can then be displaced relative to each other, as indicated by the arrow S in FIG. 2*e*, so that they rest congruently on one another to be transported away, as FIG. 2*f* shows.

Figure 3:
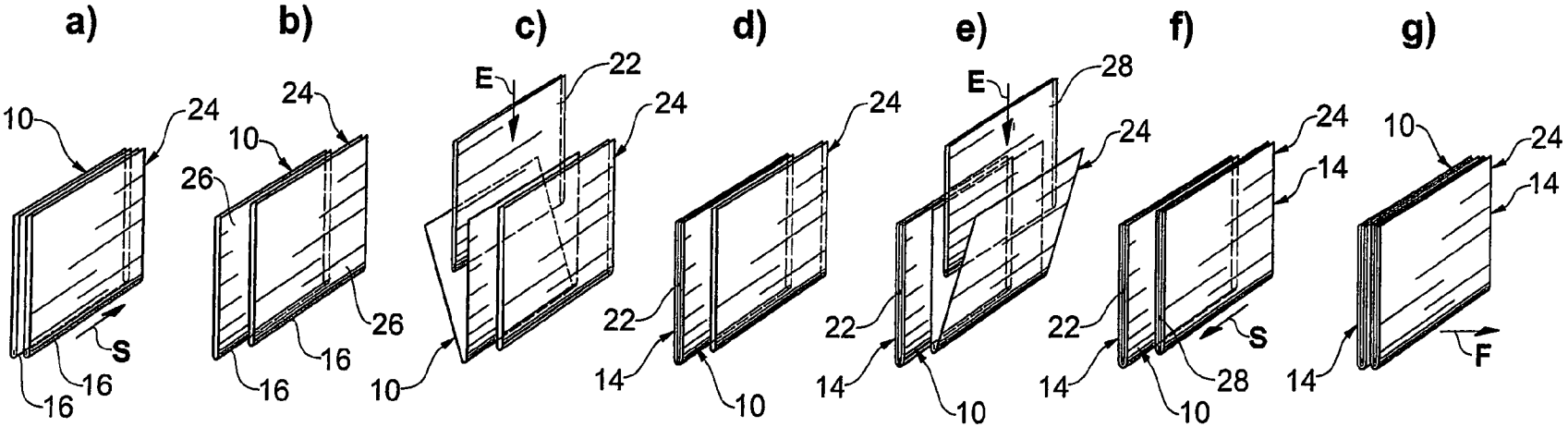
FIG. 3 shows, in the same illustration as FIG. 1, steps of a third embodiment of the method according to the invention, in which the two printed products are arranged congruently, are then displaced and in each case a product for insertion is inserted into each of the printed products one after the other.

In embodiment of the method for producing final printed products 14 illustrated in FIG. 3, in each case a first printed product 10 and a second printed product 24 are introduced into a compartment 12, resting congruently against each other. As indicated by the arrow S in FIG. 3*a*, the two printed products 10 and 24 in the compartment 12 are displaced relative to each other in the direction of the folds 16, so that the first printed product 10 and the second printed product 24 each project with an edge section 26 beyond the other printed product; see FIG. 3*b* in this regard.

As indicated in FIG. 3*c*, the first printed product 10 is then opened and a first product for insertion 22 is inserted into the latter in the insertion direction E. The printed product 10 completed to form a final printed product 14 is then closed again, as FIG. 3*d* shows.

Following the subsequent opening of the second printed product 24—see FIG. 3*e*—a second product for insertion 28 is inserted into the latter in the insertion direction E.

After that, the second printed product 24 completed to form a final printed product 14 is then closed, as indicated in FIG. 3*f*. The two final printed products 14 can again be conveyed away in a position displaced relative to each other or, as indicated by the arrow S, can be displaced into a position congruent relative to each other in the compartment, which position is shown in FIG. 3*g*, to be transported away.

In an embodiment of the method for producing final printed products 14 shown in FIG. 4, once again the first printed product 10 and the second printed product 24 are introduced into a compartment 12 simultaneously and resting congruently against each other. As indicated by the arrow S in FIG. 4*a*, once again the two printed products 10, 24 are displaced relative to each other in the direction of their folds 16, so that the first printed product 10 projects with an edge section 26 beyond the second printed product 24. In a corresponding way, the second printed product 24 also projects with an edge section 26 beyond the first printed product 10.

Then, as FIG. 4*c* shows, simultaneously or shortly after each other, the first printed product 10 and the second printed product 24 are opened and a first and, respectively, a second product for insertion 22, 28 are inserted simultaneously into these printed products 10, 24 in the insertion direction E.

Then, the two printed products 10, 24 completed by insertion to form a final printed product 14 are closed—FIG. 4*d*—and are conveyed away in their position displaced relative to each other or, as indicated by the arrow S, are brought into a congruent position, shown in FIG. 4*e*, to be conveyed away.

Figure 4:
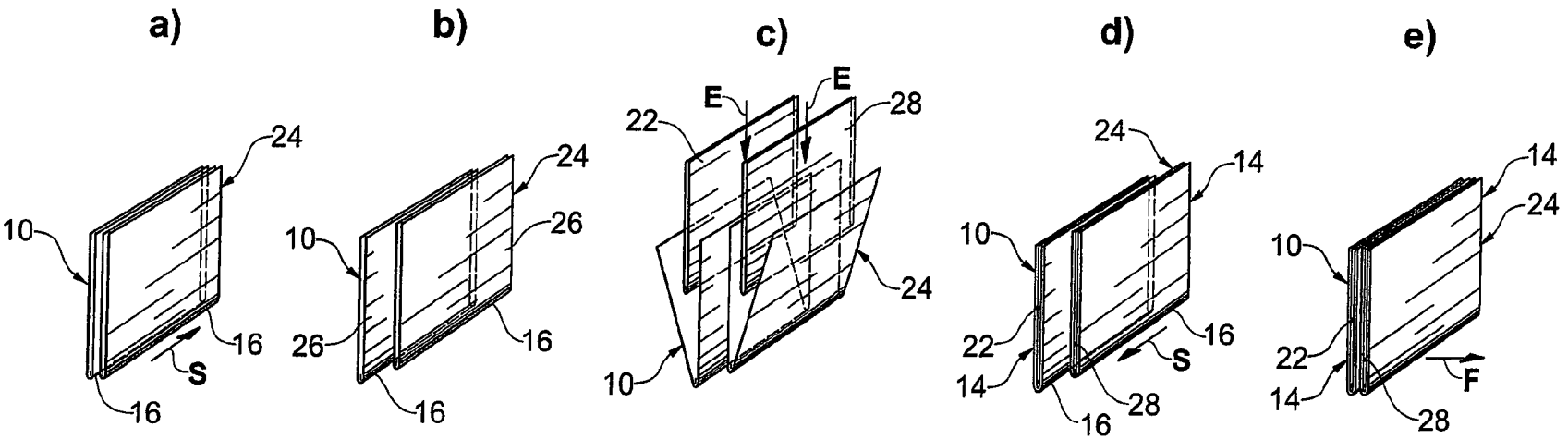
FIG. 4 shows, in the same illustration as FIG. 1, steps of a fourth embodiment of the method according to the invention, in which in each case a product for insertion is inserted simultaneously into the two printed products.

In the embodiment illustrated in FIG. 4, it is also possible to insert the products for insertion 22, 24 into the opened and held open printed products 10 and, respectively, 24 not simultaneously but one after the other.

Figure 5:
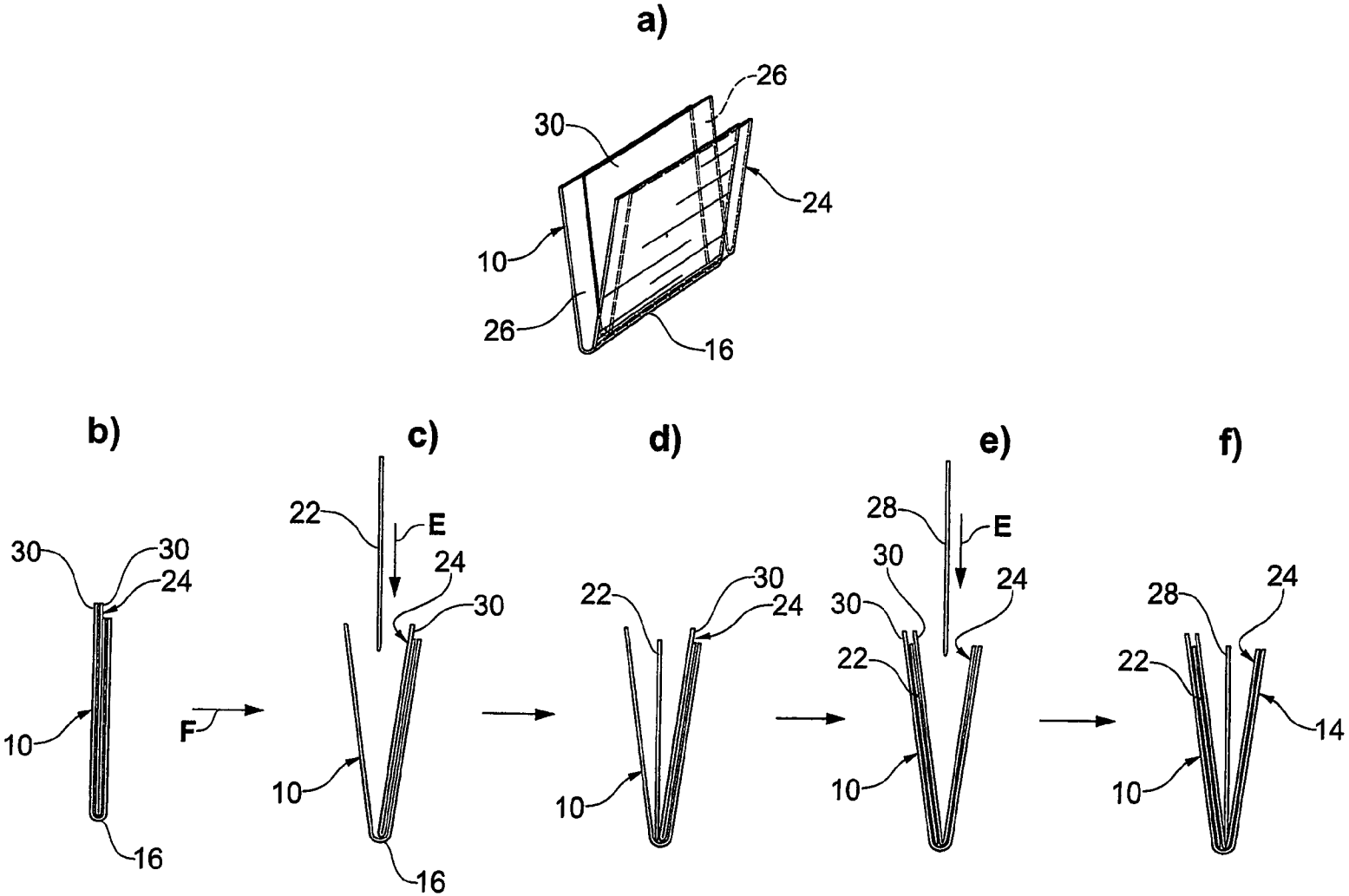
FIG. 5*a* shows, in a perspective illustration, a folded first printed product and a second likewise folded printed product, which is arranged in the first printed product so as to be displaced in the longitudinal direction of the folds.
FIG. 5*b* to *f* show a further embodiment of the method according to the invention at five different times, in which a product for insertion is inserted into each of the printed products shown in FIG. 5*a;*

In FIG. 5, an embodiment of the method for producing final printed products 14 is illustrated in which the folded first printed product 10 and a likewise folded second printed product 24 arranged in the latter and displaced in the direction of the folds 16 are introduced into a compartment 12 with each other. It is also possible to populate the compartment 12 with the first printed product 10 and to introduce the second printed product 24 into the latter so as to be displaced in the direction of the folds 16, so that once more the situation shown in FIG. 5*a* is given, it being possible for these two printed products 10, 24 to be closed, as shown in FIG. 5*b*.

Starting from FIG. 5*a*, the inner second printed product 24 is closed or, starting from FIG. 5*b*, only the outer first printed product 10 is opened. Then, as indicated by the arrow E in FIG. 5*c*, a first product for insertion 22 is inserted into the first opened printed product 10, this first product for insertion 22 coming to lie beside the second printed product 24, as FIG. 5*d* shows.

The second printed product 24 is then opened, and a second product for insertion 28 is inserted into the latter, as indicated by the arrow E; FIG. 5*e*. FIG. 5*f* shows the first printed product 10 with the first product for insertion 22 inserted therein and the opened second printed product 24, arranged beside the latter, with the second product for insertion 28 inserted therein.

There is the possibility of removing the second printed product 24 with the second product for insertion 28 arranged therein from the first printed product 10 as a final printed product 14. However, there is also the possibility of displacing the two printed products 10, 24 with the corresponding products for insertion 22, 28 in the direction of the folder 16, so that they are arranged congruently. In this case, the final printed product 14 is formed by the first printed product 10, the second printed product 24 and the two products for insertion 22, 28.

In the embodiment shown in FIG. 5, the first printed product 10 and the second printed product 24 are folded off-center, so that a strip-like edge region of the one product part, designated a prefold 30, projects beyond the other product part. The second printed product 24 is arranged in the first printed product 10 in such a way that the products having the prefolds 30 face each other.

Since in each case the second printed product 24 is arranged to be displaced in the direction of the folds 16 with respect to the first printed product 10, by means of opening devices it is possible to make access to the first printed product 10 and, respectively, the second printed product 24 in the relevant edge sections 26 without there being any risk that the wrong printed product 10, 24 will be opened. If the printed products 10, 24 have a prefold 30, then by acting on the prefold 30 in the relevant edge section 26, the relevant printed product 10, 24 can be opened centrally in a straightforward manner. If, in the case of multi-sheet printed products 10, 24, it does not matter between which pages the products for insertion 22 and 28 come to lie, then the printed products 10, 24 do not need to have a prefold 30 and the printed products 10, 24 can be opened at any desired point, for example by plunging in by means of an opening blade, by means of an air jet or the like. In this case, too, the opening process of the printed products 10, 24 begins in the relevant edge section 26.

The above description of FIGS. 1 to 5 is based on the system in which a single pocket-like compartment 12 is considered, which is loaded with a first printed product 10 and with a second printed product 24, the successive method steps being illustrated at successive times. However, FIGS. 1 to 5 can also be read in such a way that the method steps carried out simultaneously and at different points of an appropriate apparatus are illustrated.

Figure 6:
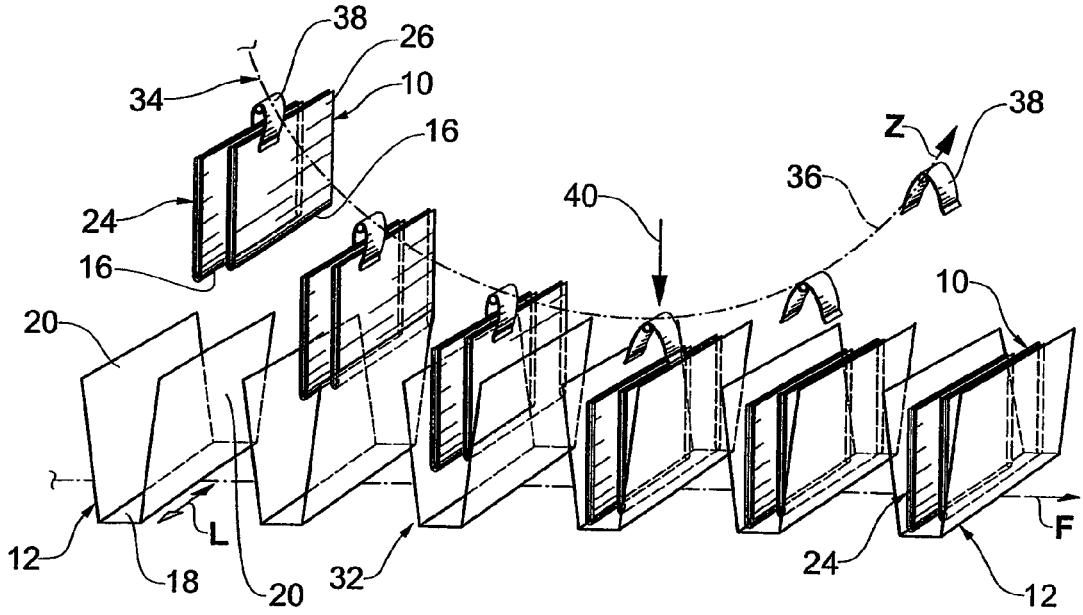
FIG. 6 shows, in a perspective illustration, a detail of an apparatus for producing final printed products, having pocket-like compartments arranged one after another in a conveying direction, which are loaded by means of a feeder with in each case two printed products resting flat against each other and arranged so as to be displaced.

FIG. 6 shows a perspective illustration of a loading section 32 of an apparatus for producing final printed products 14, having pocket-like compartments 12 arranged one after another and driven in circulation in the conveying direction F. Each of these compartments 12 has a base 18 and two side walls 20 adjacent thereto. The longitudinal direction L of the compartments 12 runs at right angles to the conveying direction F.

In the loading section 32, a feeder 34 constructed as a clamp transporter runs above the apparatus. On a conveying element 36 driven in circulation in the feed direction Z, clamps 38, which are each populated with a first printed product 10 and a second printed product 24, are arranged one after another at intervals. The two printed products 10, 24 rest flat against each other but are arranged so as to be displaced in the direction of the folds 16, so that once more each of the printed products 10, 24 has an edge section 26 projecting beyond the other printed product 10, 24. The movement path of the clamps 38, as viewed in the feed direction Z, first of all has falling inclines toward the circulation path of the compartments 12, so that the printed products 10, 24 held by each of the clamps 38 meet the interior of an associated compartment 12. At the lowest point of the movement path of the clamps 38 there is arranged an opening device 40, which opens each clamp 38 leading past, the latter in turn releasing the two printed products 10, 24 held by it. The compartments 12 leaving the loading section 32 are each populated with a first printed product 10 and a second printed product 24 arranged so as to be displaced with respect to the latter, which corresponds to the starting position of the method for producing final printed products 14 illustrated in FIG. 2*a*.

Figure 7:
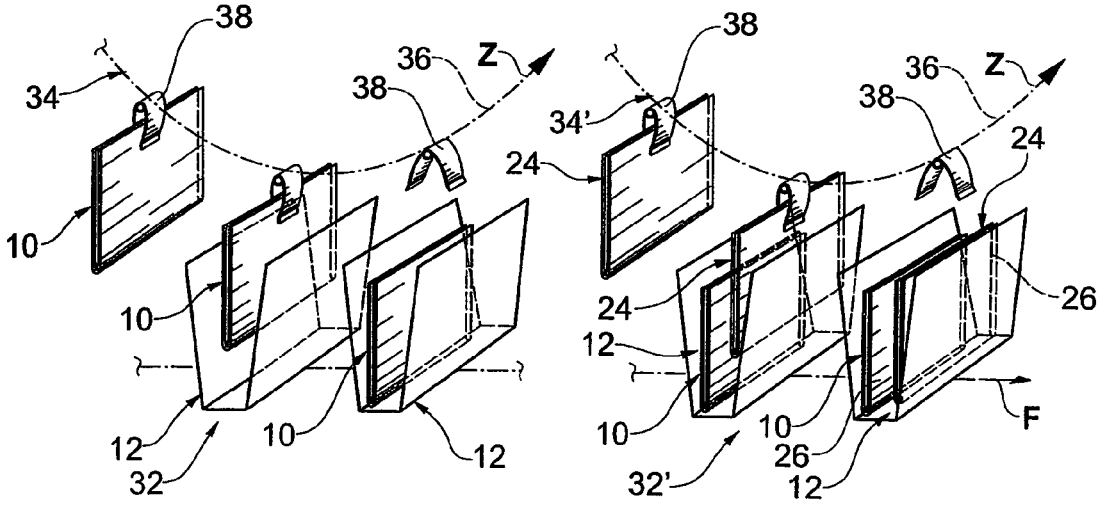
FIG. 7 shows, likewise in a perspective illustration, two details of an apparatus for producing final printed products, having pocket-like compartments arranged one after another in a conveying direction, which are loaded by means of a first feeder with a first printed product in each case and are loaded with a second printed product, arranged to be displaced laterally, by means of a second feeder.

FIG. 7 shows a first loading section 32 and a second loading section 32' of a further embodiment of the apparatus for producing final printed products 14. This apparatus once more has compartments 12 arranged one after another and driven in circulation in the conveying direction F. In the first loading section 32, by means of a first feeder 34, which is constructed as described in connection with FIG. 6, each of the compartments 12 is fed with a first printed product 10. In the second loading section 32', by means of a second feeder 34', which can be constructed in the same way as the first feeder 34, each of the compartments 12 is loaded with a second printed product 24. In order that these second printed products 24 come to lie in the compartments 12 so as to be displaced with respect to the first printed product in the longitudinal direction L of the compartments 12 and thus in the direction of the folds 16 of the printed products 10, 24, the second feeder 34' is arranged to be offset appropriately laterally with respect to the circulation path of the compartments 12.

After the second loading section 32', the starting position of the printed products 10, 24 shown in FIG. 2*a* has been reached in each of the compartments 12.

However, the second loading section 32' can be further removed from the first loading section 32, so that, between these two loading sections, the first printed product 10 can be opened and populated with a first product for insertion 22, as illustrated in FIGS. 1*a*-1*c*. In the second loading section 32', the second printed product 24 then comes to lie beside the first printed product 10 completed to form the final printed product 14; FIG. 1*d*.

Figure 8:
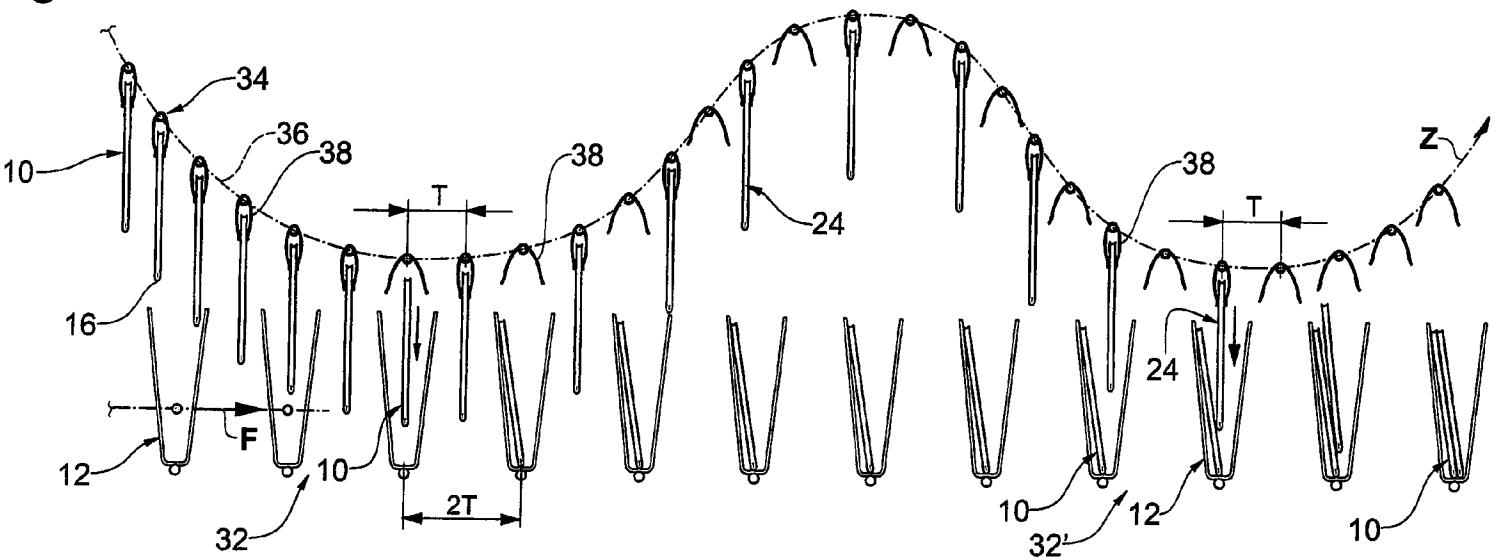
FIG. 8 shows, in an elevation, a detail of an apparatus for producing final printed products, having pocket-like compartments arranged one after another in a conveying direction and a feeder, which loads each of the compartments with a first printed product first and then loads each of the compartments with a second printed product, arranged to be offset laterally.
Figure 9:
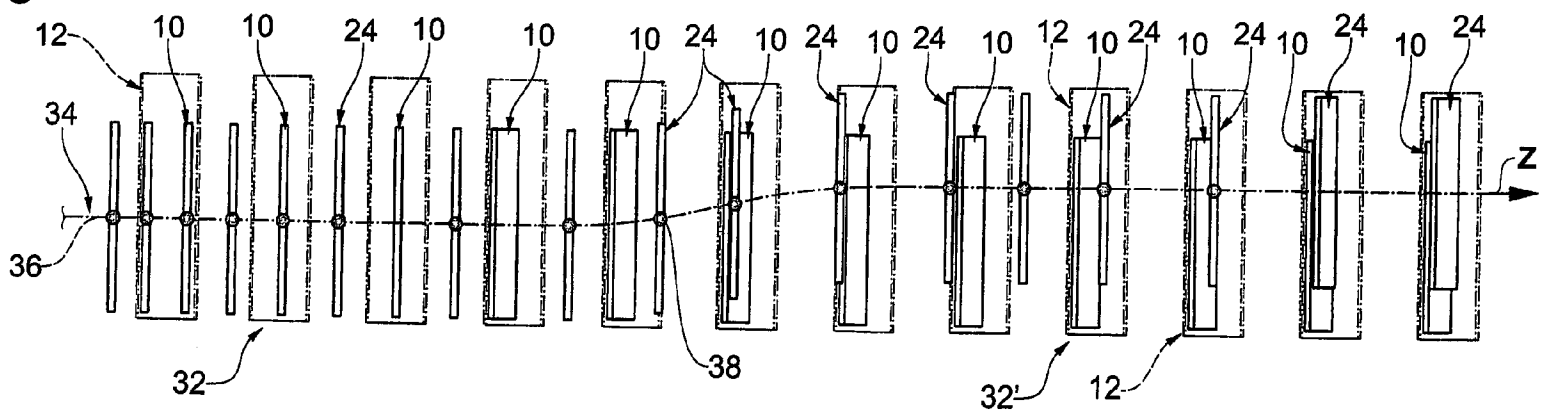
FIG. 9 shows the apparatus illustrated in FIG. 8 in plan view.

FIGS. 8 and 9 show two loading sections 32, 32' immediately following each other of the apparatus for producing final printed products 14. This again has pocket-like compartments 12 arranged one after another at intervals and driven in circulation in the conveying direction F. The feeder 34 is once more constructed as a clamp transporter, the clamps 38 being arranged at intervals T on the conveying element 36 driven in circulation in the feed direction Z. Relative to the clamps 38, the compartments 12, are arranged at a center spacing from one another which is twice as large, as indicated by the arrow 2T. The clamps 38 are alternately populated with a first and a second printed product 10, 24. In the first loading section 32, the first printed products 10 held by each second clamp 38 intermesh with a compartment 12, while the second printed products 24 held by the clamps 38 located in between come to lie between adjacent compartments 12 in each case. At the lowest point of the movement path of the clamps 38, the relevant clamps 38 are opened, so that each compartment 12 is populated with a first printed product 10.

Between the first loading section 32 and the second loading section 32', the movement path of the feeder 34 runs in the manner of a humpback, so that the second printed products 24 held by the relevant clamps 38, cease to overlap with the compartments 12 in the vertical direction. As can be gathered in particular from FIG. 9, the feeder 34 has an S-shaped course in the region of the humpback, as seen in plan view, so that in the second loading section 32' of the feeder 34, as compared with the first loading section 32, it runs so as to be displaced laterally. The humpback shape of the movement path and the lateral offset lead to each clamp 38 holding a second printed product 24 meeting a compartment 12 in the loading section 32. This leads to each compartment 12 already populated with a first printed product 10 being fed with a second printed product 24 displaced laterally in the second loading section 32'. At the outlet from the second loading section 32', in each compartment 12 there is arranged a first printed product 10 and, displaced in relation to the latter, a second printed product 24, as corresponds to FIG. 2*a*.

Figure 10:
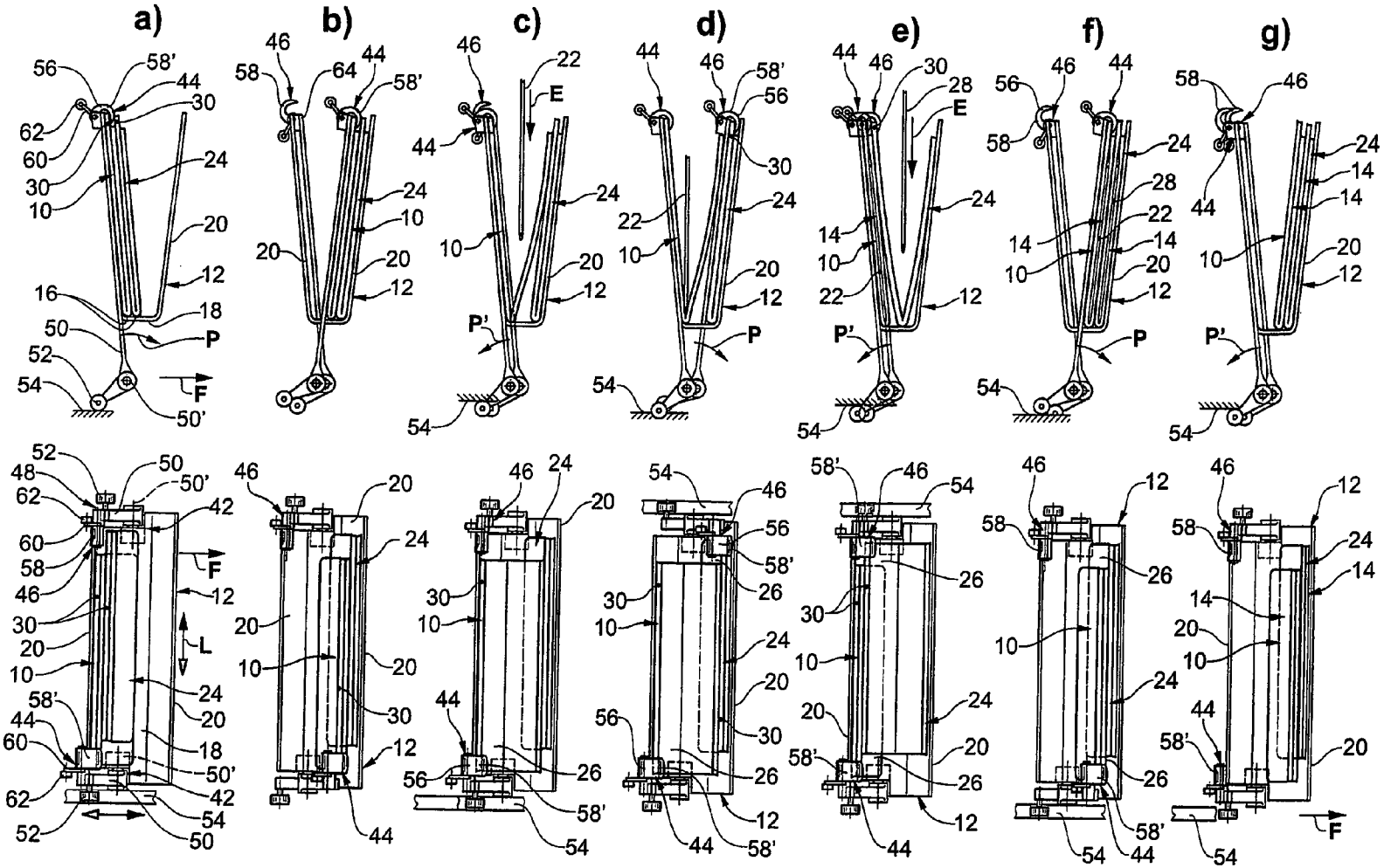
FIG. 10 shows, in elevation and underneath in plan view, a pocket-like compartment of an apparatus according to the invention at different times during the population of the printed products with a product for insertion in each case.

FIG. 10 shows, in each case in elevation and in plan view, a compartment 12 with a first printed product 10 and a second printed product 24 arranged therein at seven different times, designated a to g, of the insertion sequence of a first product for insertion 22 and a second product for insertion 28 in accordance with the method illustrated in FIG. 2 and FIG. 3—beginning at the time according to FIG. 3*b*.

The compartment 12 has a base 18 and two side walls 20 adjacent thereto and arranged in a v-shape, of which, as seen in the conveying direction F, one side wall 20 leads and the other trails. The trailing side wall 20 has an extent measured in the longitudinal direction L extending at right angles to the conveying direction F which corresponds to the length measured in the direction of the folds 16 of the two printed products 10 and 24 arranged to be displaced relative to each other. The two printed products 10 and 24 rest with their fold 16 on the base 18, and the first printed product 10 rests with its outer side having the prefold 30 flat against the trailing side wall 20. The second printed product 24 rests with its side having the prefold 30 against the first printed product 10. Measured from the base 18, the height of the side walls 20 corresponds approximately to the corresponding extent of the printed products 10, 24.

In its end regions 42, 42' facing away from each other in the longitudinal direction L, the compartment 12 has a gripper 44, 46 in each case. The first gripper 44 located in the first end region 42 is intended to interact with the prefold 30 of the first printed product 10 in its edge section 26 projecting beyond the second printed product 24. In a corresponding way, the second gripper 46 arranged in the other end region 42' is intended to interact with the prefold 30 of the second printed product 24 in its edge section 26 projecting laterally beyond the first printed product 10.

As can be gathered from FIG. 10*a*, the two grippers 44, 46, when in their rest position 48, are located by the trailing side wall 20, in the upper exposed corner regions of the latter. Each of the grippers 44, 46 is arranged on a pivoting lever 50, which runs laterally outside the trailing side wall 20 and underneath the base 18 or at the base is mounted on a carrier for the compartment 12, not shown for improved clarity. The pivot axis 50' of the pivoting lever 50 extends in the longitudinal direction L. The pivoting levers 50 are formed as two-armed levers, one lever arm bearing the associated gripper 44, 46 at its free end and the other lever arm bearing a freely rotatably mounted control roller 52 at its end. The control rollers 52 are intended to interact with pivoting slotted guides 54.

Each of the two grippers 44, 46 has a sickle-shaped gripper arm 56, which can be pivoted from a release position 58—in FIG. 10*g* the gripper arms 56 of both grippers 44, 46 are in the release position 58—into a holding position 58'—as shown in FIGS. 10*d* and *e*—and back again. The gripper arms 56 are pivoted in a known way under the control of slotted guides, of this slotted guide control only one control lever 60 connected to the relevant gripper 56 and a follower roller 62 freely rotatably mounted on the latter being shown in FIG. 10. The gripper arms 56 interact with a gripper jaw 64 which is arranged to be fixed with respect to the associated pivoting lever 50. Said gripper jaw 64 can be constructed in the manner of a tongue, so that, when the grippers 44, 46 are located in the rest position 48, it rests flat against the trailing side wall 20. However, it can also be constructed differently and, in the rest position 48, can be located in a cut-out in the corner regions of the trailing side wall 20. It is also conceivable that the trailing side wall 20 is designed to be shorter than shown in the longitudinal direction L, so that the printed products 10, 24 project laterally beyond the trailing side wall 20 and the grippers 44, 46 are located laterally beside the trailing side wall 20.

It goes without saying that, when the compartments 12 are being loaded with printed products 10, 24, the grippers 44, 46 are in the rest position 48 and the gripper arms 56 are in the release position 58, in order not to form an obstacle during the introduction of the printed products 10, 24 into the compartments 12.

The functioning of the apparatus for producing final printed products 14 with compartments 12 of this type is as follows. First of all, as indicated in FIG. 10*a*, the gripper arm 56 of the first gripper 44 is moved into the holding position 58'. In the process, it grips the prefold 30 of the first printed product 10 in the edge section 26. Then, by means of the associated pivoting slotted guide 54, as indicated by the arrow P in FIG. 10*a*, the first gripper 44 is pivoted in the direction of the leading side wall 20, so that, with the printed products 10, 24 resting against each other, the second printed product 24 comes into contact with the leading side wall 20, as FIG. 10*b* shows.

Then, as shown in FIG. 10*c*, by means of the associated pivoting slotted guide 54, the first gripper 44 holding the prefold 30 of the first printed product 10 is pivoted back in the direction of the arrow P' into the rest position 48, which means that the first printed product 10 is opened. The first product for insertion 22 is then inserted into the first printed product 10 in the insertion direction E. Of course, a plurality of products for insertion can be inserted into the opened first printed product 10.

While the gripper arm 56 of the first gripper 44 remains in the holding position 58'—as FIG. 10*d* shows—the second gripper 46 is pivoted in the direction of the arrow P toward the leading side wall 20 by means of the associated slotted guide 54, and the gripper arm 56 of the second gripper 46 is pivoted into the holding position 58', so that the prefold 30 of the second printed product 24 is gripped in the edge section 26 projecting beyond the first printed product 10. As a result of the closed second gripper 46 then being pivoted back in the direction of the arrow P' into the rest position 48 by means of the associated pivoting slotted guide 54—FIG. 10*e*—the second printed product 24 is opened. A second product for insertion 28, or else a plurality of second products for insertion, is/are then inserted into said second printed product 24 in the insertion direction E.

Following the opening of the second gripper 46 by pivoting its griper arm 56 into the release position 58, the first gripper 44, which is still closed, is pivoted in the direction of the arrow P—FIG. 10*f*—by means of the associated pivoting slotted guide 54 in such a way that the second printed product 24, supplemented to form a final printed product 14, is closed and, at the same time, the first printed product 10 previously supplemented to form a final printed product 14 is moved toward the side wall 20. Following the opening of the first gripper 44 by pivoting the gripper arm 56 into the release position 58, the first gripper 44 is moved in the direction of the arrow P' into the rest position 48 by the trailing side wall 20 by means of the associated slotted control guide 54. The two final printed products 14 produced, now resting against each other, rest against the leading side wall 20; FIG. 10*g*. If further processing is necessary, they can continue to remain in the compartment 12 or can be conveyed away in their position displaced with respect to each other or moved into a congruent position by displacement.

FIG. 10 also can be interpreted in such a way that it shows a section of an apparatus for producing final printed products 14 having pocket-like compartments 12 arranged one after another and driven in circulation in the conveying direction F, that which takes place in the various compartments 12 being illustrated at the same time.

Figure 11:
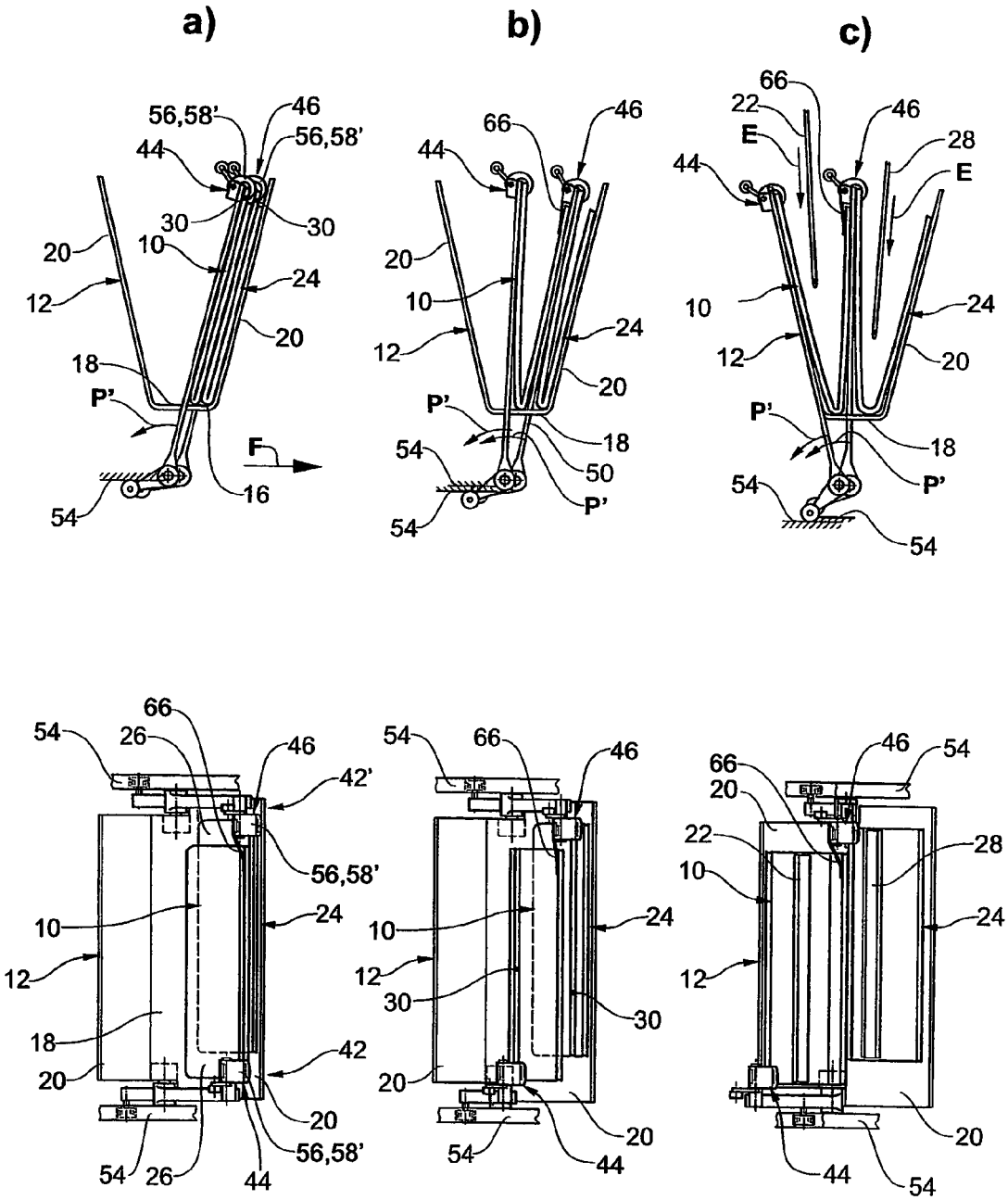
FIG. 11 likewise shows, in elevation and underneath in plan view, a pocket-like compartment of an apparatus according to the invention at three different times, the two printed products being populated simultaneously with a product for insertion in each case.

In the apparatus for producing final printed products 14, shown as a detail in FIG. 11, the pocket-like compartments 12 arranged one after another in the conveying direction F and driven in circulation are constructed in a manner very similar to the compartments 12 shown in FIG. 10 and described further above. The base 18 of the compartments, as seen in the conveying direction F, has a greater extent and the two side walls 20 are likewise arranged in a v-shape but with a greater opening angle in relation to each other. In the two lateral end regions 42, 42' of each compartment 12 there is a first gripper 44 and a second gripper 46, respectively, which are constructed in the same way and driven in the same way as shown in FIG. 10.

Arranged on the pivoting lever 50 bearing the second gripper 46 is a holding tongue 66, which can likewise be pivoted under slotted guide control from a rest position into an active position and back. As indicated in FIG. 11*a*, after a compartment 12 has been populated with a first printed product 10 and a second printed product 24, the first gripper 44 and the second gripper 46 are pivoted from their rest position 48 by the trailing side wall 20, so that the opened first gripper 44 comes into contact with its gripper jaw 64 on the prefold 30 of the first printed product 10 in the projecting edge section 26. This is correspondingly true of the second gripper 46 and the second printed product 24. By pivoting the two gripper arms 56 into the holding position 58', the first printed product 10 is gripped at its prefold 30, and the second printed products 24 is gripped at its prefold 30 by the first and, respectively, the second gripper 44, 46. After that, as indicated by the arrow P in FIG. 11*a*, by means of the corresponding pivoting slotted guide 54, the first gripper 44 is pivoted approximately into a central position between the two side walls 20, as illustrated in FIG. 11*b*. As a result, the first printed product 10 is opened. The holding tongue 66 is then pivoted into the opened first printed product 10, and holds the part of the first printed product 10 not having a prefold 30 in contact with the part of the second printed product 24 having the prefold 30. As indicated by the two arrows P' in FIG. 11*b*, both grippers 44, 46 are then pivoted together in the direction toward the trailing side wall 20. This means that the first printed product 10 is opened completely, and so is the second printed product 24. In the process, the first gripper 44 is moved as far as its rest position 48 by the trailing side wall 20, whereas the second gripper 46 is stopped in a central position between the two side walls 20, as FIG. 11*c* shows. Then, a first product for insertion 22 can be inserted into the first opened printed product 10 and, simultaneously, a second product for insertion 28 can be inserted into the opened second printed product 24 in the insertion direction E, as has already been explained in connection with FIG. 4.

Both the apparatus shown in FIG. 10 and the apparatus shown in FIG. 11 are suitable for carrying out all the methods described further above. Only the pivoting slotted guides 54 have to be adapted appropriately.

The grippers 44, 46 can also be constructed as suction heads, in particular if the printed products 10, 24 do not have to be opened centrally.

If desired, the compartments 12 can also be provided with sliding means, in order to displace the first printed product 10 and the second printed product 24 relative to each other in the longitudinal direction L of the compartments 12, in order either to displace the printed products 10, 24 introduced congruently into the compartments 12 in order to form projecting, free edge sections 26 or, following the formation of the final printed products 14, to slide these toward each other congruently. For the latter, it is also conceivable to provide stationary slotted slide guides, which engage in the compartments 12 through appropriate slots in the side walls as said compartments 12 move past, and as a result slide the final printed products 14 toward each other.

The printed products 10, 24 arranged in each compartment 12 are, however, not conveyed together in the longitudinal direction L of the compartments 12 from one compartment into another compartment adjacent thereto.

The method according to the invention and the apparatus according to the invention allow identical or different final printed products 14 to be produced with a high processing capacity. For the production of identical final printed products 14, the first and second printed products 10, 24 are identical and the first and second products for insertion 22, 28 are identical. If the first and second printed products 10, 24 and/or the first and second products for insertion 22, 28 are different, different final printed products 14 are produced.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A method for producing final printed products, comprising:

introducing a first printed product and a second printed product into a pocket-like compartment, each of the first and second printed products being folded about a respective first and second fold axis to form a fold and defining opposing first and second edge sections spaced apart along the respective fold axis, such that the first and second fold axes are arranged substantially parallel to each other; and inserting a first product for insertion into the first printed product and a second product for insertion into the second printed product, wherein, during insertion of the second product for insertion, one of the first and second printed products is arranged to be displaced along the corresponding fold axis, with respect to the other of the first and second printed products, such that the first edge section of the one of the first and second printed products axially projects beyond the first edge section of the other of the first and second printed products, and such that the second edge section of the other of the first and second printed products axially projects beyond the second edge section of the one of the first and second printed products.

2. The method as claimed in claim 1, wherein the first and the second printed products are introduced simultaneously into the pocket-like compartment in displaced relation along the fold axes relative to each other.

3. The method claimed in claim 2, wherein the first product for insertion is inserted before the second product for insertion is inserted.

4. The method as claimed in claim 1, wherein the first and the second printed products are introduced simultaneously and congruently into the pocket-like compartment and are displaced along the fold axes relative to each other when in the pocket-like compartment.

5. The method as claimed in claim 4, wherein the first and second products for insertion are inserted simultaneously into the respective first and second printed products.

6. The method as claimed in claim 4, wherein the first product for insertion is inserted before the second product for insertion is inserted.

7. The method as claimed in claim 1, wherein the first and the second products for insertion are inserted simultaneously into the respective first and second printed products.

8. The method as claimed in claim 1, wherein the first product for insertion is inserted before the second product for insertion is inserted.

9. The method as claimed in claim 1, wherein the first printed product is introduced into the pocket-like compartment before the second printed product is introduced into the pocket-like compartment in displaced relation along the fold axes with respect to the first printed product.

10. The method as claimed in claim 9, wherein the first product for insertion is inserted into the first printed product in the pocket-like compartment before the second printed product is introduced into the pocket-like compartment.

11. The method as claimed in claim 1 wherein the first and the second printed products are each opened at an edge opposite the fold in order to insert the respective first and second products for insertion, and opening of the second printed product is initiated about the one of the first and second edge sections thereof axially projecting beyond the corresponding edge section of the first printed product.

12. The method as claimed in claim 1, wherein the first and the second printed product are one of arranged one within the other in the pocket-like compartment and arranged one beside the other in the pocket-like compartment.

13. The method as claimed in claim 1, wherein the pocket-like compartment comprises one of a plurality of pocket-like compartments which are arranged one after another in a conveying direction, with the pocket-like compartments each defining a longitudinal direction extending transversely to the conveying direction, and wherein said introducing and inserting steps are performed with respect to each of the pocket-like compartments as the pocket-like compartments are moved in the conveying direction.

14. The method as claimed in claim 13 wherein, during the introducing step, the folds of the first and second printed products are parallel to each other and extend in the longitudinal direction.

* * * * *